US010079132B1

(12) United States Patent
Flores Silguero et al.

(10) Patent No.: US 10,079,132 B1
(45) Date of Patent: Sep. 18, 2018

(54) SYSTEMS, APPARATUS, AND METHODS FOR ELECTRIC CIRCUIT BREAKER TRIPPING

(71) Applicant: Siemens Industry, Inc., Alpharetta, GA (US)

(72) Inventors: Carlos Flores Silguero, Doraville, GA (US); Pedro Rivera Romano, Nuevo Leon (MX); Eugenio Galvan Guzman, Nuevo Leon (MX)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/446,300

(22) Filed: Mar. 1, 2017

(51) Int. Cl.
*H01H 71/16* (2006.01)
*H01H 9/54* (2006.01)

(52) U.S. Cl.
CPC ..... *H01H 71/16* (2013.01); *H01H 9/54* (2013.01)

(58) Field of Classification Search
CPC ..... H01H 71/16; H01H 9/54
USPC ..... 337/360, 102–105, 377
See application file for complete search history.

(56) References Cited

U.S. PATENT DOCUMENTS 1,920,806 A * 8/1933 Rich ..... H01H 61/02 337/101
3,735,316 A * 5/1973 Thorsteinsson ..... H01H 37/20 337/101
4,001,743 A 1/1977 Arnhold
5,103,202 A * 4/1992 Lennon ..... H01H 77/04 337/100
5,182,538 A * 1/1993 Muller ..... H01H 9/10 200/83 P
5,233,325 A * 8/1993 Takeda ..... H01H 1/504 337/102
6,995,647 B2 * 2/2006 Stiekel ..... H01H 37/5418 337/102
8,188,831 B2 * 5/2012 Morishita ..... H01H 71/7445 335/145
8,218,280 B2 * 7/2012 Moffitt, II ..... H02H 3/085 361/93.8
9,000,880 B2 * 4/2015 Takeda ..... H01H 37/54 337/102
2011/0013330 A1 * 1/2011 Crevenat ..... H01H 83/10 361/115
2015/0116881 A1 4/2015 Burnett

FOREIGN PATENT DOCUMENTS

DE 2504954 A1 7/1976

* cited by examiner

*Primary Examiner* — Anatoly Vortman

(57) ABSTRACT

Embodiments provide systems, apparatus, and methods for circuit breaker tripping. Embodiments include providing a circuit breaker with a thermoelectric tripping mechanism, the thermoelectric tripping mechanism including a thermoelectric plate disposed between a current path and a bimetal lever of the circuit breaker; applying a DC current to the thermoelectric plate to heat the bimetal lever; and deflecting the bimetal lever to press upon a trip bar in response to a current overload occurring on the current path. Numerous additional aspects are disclosed.

10 Claims, 10 Drawing Sheets

SYSTEMS, APPARATUS, AND METHODS FOR ELECTRIC CIRCUIT BREAKER TRIPPING

FIELD

The present application relates to electric circuit breakers, and more specifically to systems, apparatus, and methods for tripping of circuit breakers.

BACKGROUND

A circuit breaker is an automatically operated electrical switch designed to protect an electrical circuit from damage caused by an electrical overload or short circuit. A circuit breaker automatically opens its contacts if an overcurrent condition is sensed. To do this, a circuit breaker comprises a trip unit, which determines when the contacts are to open.

Some circuit breakers include trip units including a thermomagnetic tripping mechanism. Such breakers are well known in commercial and industrial applications. These breakers include multi-metallic strips (e.g., a strips of two or more metals with different thermal expansion rates bonded together) for triggering a thermal trip resulting from overload currents and a magnetic element for instantaneous trip resulting from short-circuit current surges. Some breakers use bimetallic, while others use tri-metallic strips that are fixed on one end (these are collectively referred to as "bimetal levers" herein). In other words, the thermomagnetic tripping mechanisms include elements designed to both sense the heat resulting from an overload condition and the high current resulting from a short circuit. In addition, some circuit breakers incorporate a "push to trip" button.

It is possible that a temperature profile for a thermomagnetic trip mechanism of a standard circuit breaker does not meet the requirements for different circuit breakers under different operating conditions. For example, increasing the temperature inside the thermomagnetic trip mechanism of a circuit breaker can generate higher temperatures on the lugs and current path that do not comply with temperature range ratings (e.g., temperatures out of the acceptable range) of the circuit breaker. While using an arrangement with a low temperature profile can reduce the heat applied to the current path of the circuit breaker, low temperatures in the bimetal lever of a thermomagnetic trip unit can result in an inadequate amount of bimetal deflection and an insufficient amount of pushing power to actuate the trip bar, latch, or latching mechanism. Although a limited amount of deflection of the bimetal lever can be compensated for when using a low temperature profile by using a calibration mechanism (e.g., an adjustment screw) to locate the end of the bimetal lever closer to the trip bar of the breaker, the deflection strength may still not be sufficient for the bimetal lever to produce enough force to rotate the trip bar and release the energy storage spring of the thermomagnetic tripping mechanism.

FIGS. 1 and 2 depict isometric and side views respectively of a circuit breaker with a conventional thermomagnetic tripping mechanism 100. The thermomagnetic tripping mechanism 100 includes an input plate 102, an output plate 104, a heater 106 and a bimetal lever 108 which receives indirect heating through the heater 106. The bimetal lever 108 can be attached to the heater 106 and/or a heater support plate 114. A trip bar 110 of the thermomagnetic tripping mechanism 100 rotates as soon as it is moved by the bimetal lever 108. Rotation of the trip bar 110 releases the energy storage spring 112 of the thermomagnetic tripping mechanism 100 to open the contacts of the circuit breaker. A thermal calibration screw 116 can be used to calibrate the thermomagnetic tripping mechanism 100 to increase or decrease the amount of deflection (and time) the bimetal lever 108 undergoes to contact the trip bar 110. The bimetal lever 108 is shown in its normal (non-deflected) position. If no current is flowing through the current path of the thermomagnetic tripping mechanism 100, the bimetal lever 108 is in a straight "normal" position.

If sufficient overcurrent flows through the circuit breaker's current path, heat build-up causes the bimetal lever 108 of the thermomagnetic tripping mechanism 100 to deflect. As the bimetal lever 108 is heated, it bends from its high thermal expansion side toward its low thermal expansion side. After bending a predetermined distance, the bimetal lever 108 contacts and pushes on the trip bar 110 activating the energy storage spring 112 and thus the trip mechanism of the circuit breaker. Typically, if approximately 20% current over the nominal current rating of the breaker flows through the current path, the bimetal lever 108 generates pushing force based on the heat generated which rotates the trip bar 110 and releases the energy storage spring 112. Therefore, to insure reliable operation of thermomagnetic circuit breakers, systems, apparatus, and methods for improved tripping of circuit breakers are desirable.

SUMMARY

In some embodiments, an improved circuit breaker is provided. Embodiments of the improved circuit breaker include a current path including contacts openable to interrupt a circuit; a thermoelectric tripping mechanism adjacent the current path, the thermoelectric tripping mechanism including a thermoelectric plate disposed between the current path and a bimetal lever; and a trip bar disposed to be pressed by the bimetal lever, the trip bar coupled to a stored energy mechanism releasable to open the contacts. A power supply is included to apply DC current to the thermoelectric plate in response to a current overload condition.

In some other embodiments, a thermoelectric tripping mechanism is provided. Embodiments of the thermoelectric tripping mechanism include a current path; a bimetal lever; and a thermoelectric plate disposed between the current path and the bimetal lever. In some embodiments, the thermoelectric tripping mechanism can further include a DC power supply coupled to the thermoelectric plate. In some embodiments, the thermoelectric plate is operative to heat the bimetal lever and use the current path as a heat sink.

In yet other embodiments, a method of tripping a circuit breaker is provided. The method includes providing a circuit breaker with a thermoelectric tripping mechanism, the thermoelectric tripping mechanism including a thermoelectric plate disposed between a current path and a bimetal lever of the circuit breaker; applying a DC current to the thermoelectric plate to heat the bimetal lever; and deflecting the bimetal lever to press upon a trip bar in response to a current overload occurring on the current path.

Still other features, aspects, and advantages of embodiments will become more fully apparent from the following detailed description, the appended claims, and the accompanying drawings by illustrating a number of exemplary embodiments and implementations, including the best mode contemplated for carrying out the embodiments. Embodiments may also be capable of other and different applications, and several details may be modified in various respects, all without departing from the spirit and scope of the disclosed embodiments. Accordingly, the drawings and descriptions are to be regarded as illustrative in nature, and not as restrictive. The drawings are not necessarily drawn to scale. The description is intended to cover all modifications, equivalents, and alternatives falling within the spirit and scope of the claims.

DETAILED DESCRIPTION

Figure 1:
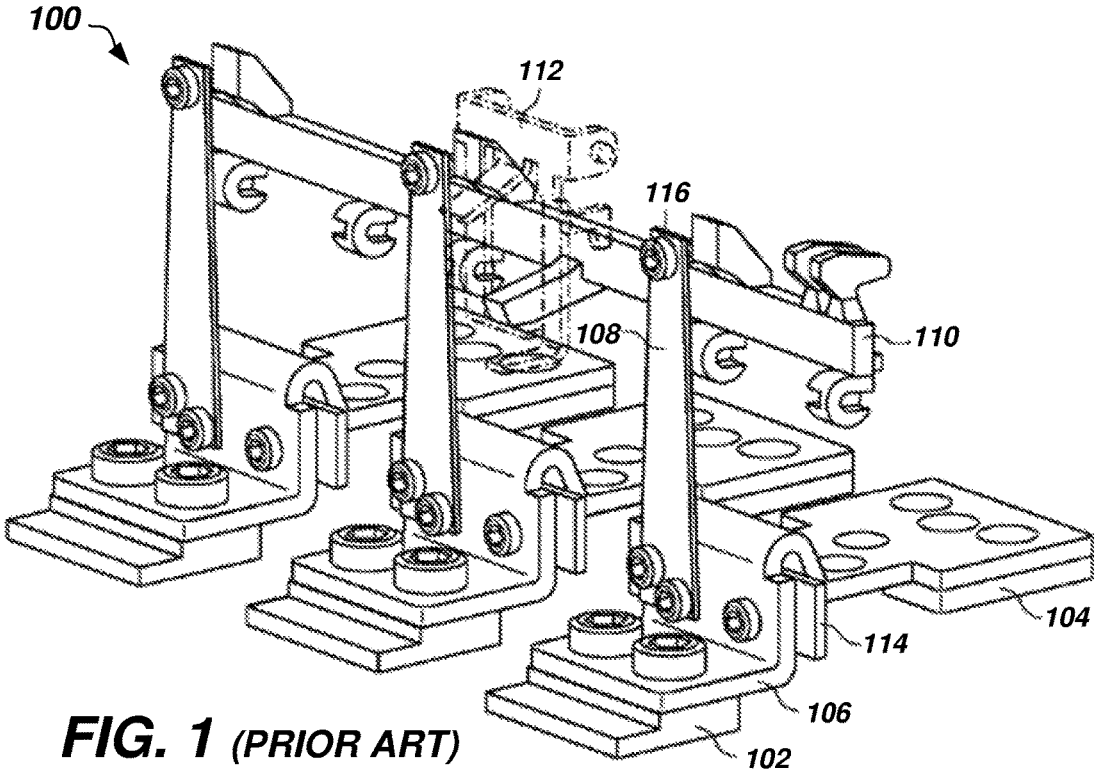
FIG. 1 (PRIOR ART)
FIG. 1 is an isometric view diagram depicting a thermomagnetic tripping mechanism according to the prior art.
Figure 2:
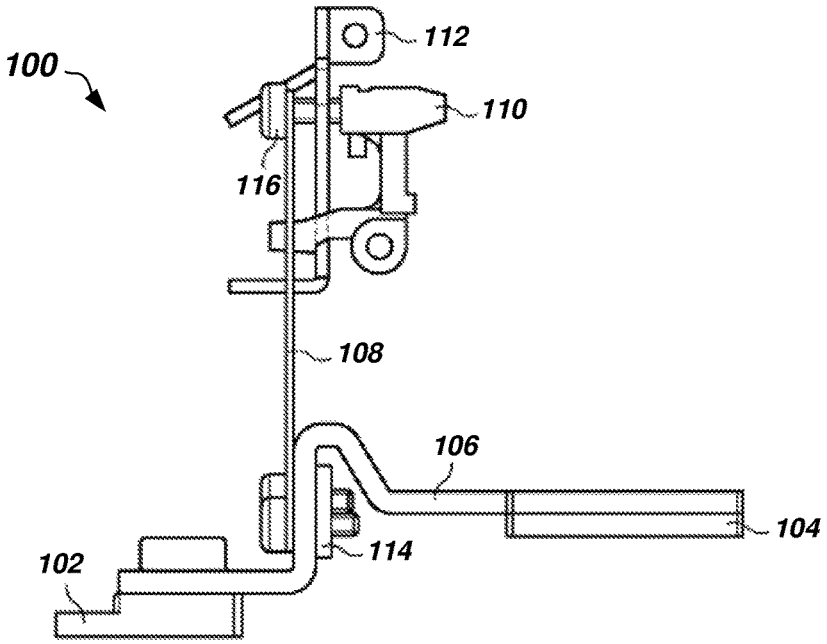
FIG. 2 (PRIOR ART)
FIG. 2 is a side view diagram depicting a thermomagnetic tripping mechanism according to the prior art.

Embodiments disclosed herein describe a thermoelectric tripping mechanism for use in a thermomagnetic circuit breaker. As discussed above, thermomagnetic circuit breakers use a bi-metallic or tri-metallic element to sense temperature on the current path and use the deflection of the bimetal lever to activate the tripping mechanism in case of an overload. To achieve sufficient deflection with adequate pushing force, the bimetal lever is conventional coupled to a heater element for indirect heating or is connected as part of the current path for direct heating. However, the heat generated from heating the bimetal is transferred to the rest of the current path, mainly by conduction and convection. As a result, the temperature of the entire circuit breaker is increased. The increased temperature can damage the lugs and cables connected to the circuit breaker, or may cause a generalized overheating condition of the surroundings of the circuit breaker.

Conventionally, in order to limit the maximum temperature of the circuit breaker during normal operation, the size of the elements in the current path, where the heater of the bimetal is located, are increased to provide more heat dissipation. In addition, more expensive materials with very good thermal or electrical conductivity are used to further help dissipate the heat. Thus, conventional thermomagnetic circuit breakers are forced to balance competing aspects: on one hand, increasing heat to achieve sufficient deflection with adequate pushing force with the bimetal lever and, on the other hand, limiting heat to prevent damage to the circuit breaker and surrounding elements. Achieving this balance has conventionally been accomplished at the expense of using larger components and more expensive materials.

The thermomagnetic circuit breakers of embodiments disclosed herein avoid the competing aspects of conventional circuit breakers. Instead, embodiments use a thermoelectric plate to heat the bimetal lever without providing extra heat to the current path. A thermoelectric plate works based on the principal of the "Peltier effect". Due to the Peltier effect, a thermoelectric plate creates voltage when there is a different temperature on each side. Conversely, when a voltage is applied to it, it creates a temperature difference. At the atomic scale, an applied temperature gradient causes charge carriers in the material to diffuse from the hot side to the cold side. This effect can be used to generate electricity, measure temperature or, in the case of embodiments disclosed herein, change the temperature of objects such as the bimetal lever. Because the direction of heating and cooling is determined by the polarity of the applied voltage, thermoelectric plates can be used as temperature controllers. The cold side of the thermoelectric plate is attached to the current path to use the current path as a heat sink. The bimetal lever is attached to the hot side to aid in deflection.

In some embodiments, a DC current is applied to the thermoelectric plate to induce the temperature gradient between the two sides. The DC current can be generated from the current path using a current transformer and a rectifier diode. The heat produced by the thermoelectric plate, is only applied to the bimetal lever without heating the entire current path. Therefore, the material cost of the current path can be reduced and the entire size of the circuit breaker can also be reduced. Circuit breakers that operate at lower temperatures than conventional breakers allow optimization the panel board design upon which they are mounted. For example, with reduced size breakers, more breakers can be included within a smaller panel. Further, by controlling the DC current applied to the thermoelectric plate so that it only flows above a predefined value, the thermal calibration process of the circuit breaker can be eliminated or greatly simplified.

Figure 3:
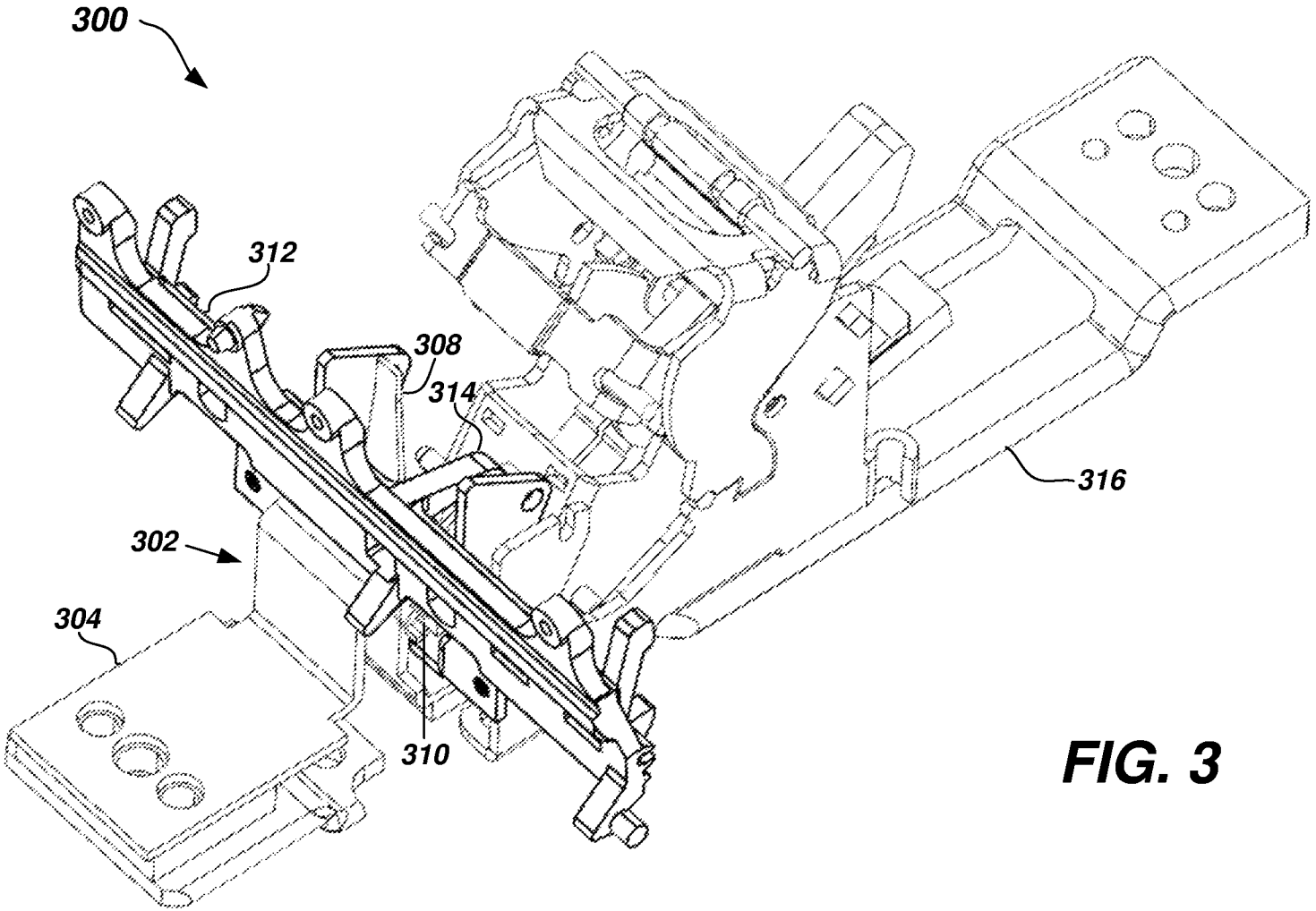
FIG. 3 is an isometric view diagram depicting an example thermomagnetic circuit breaker according to some embodiments.
Figure 4:
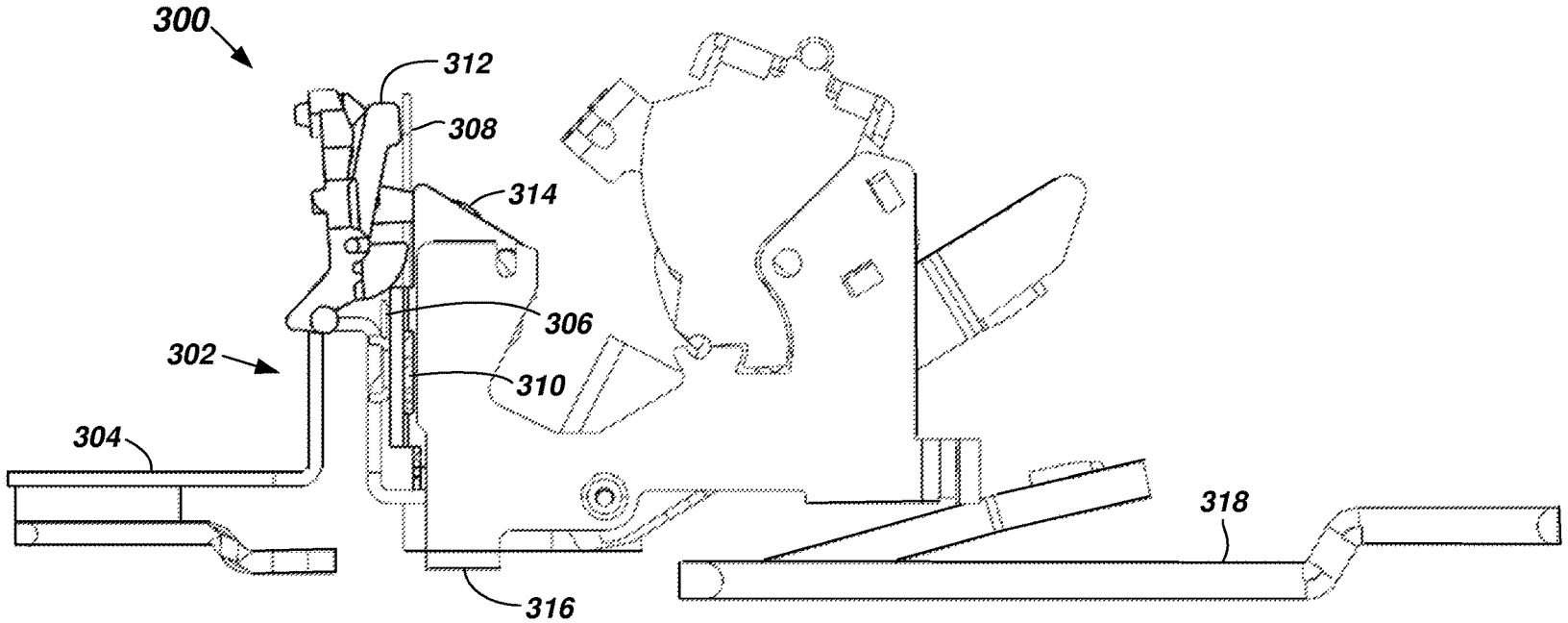
FIG. 4 is a side view diagram depicting an example thermomagnetic circuit breaker according to some embodiments.

Turning now to FIGS. 3 and 4, an example of a thermomagnetic circuit breaker 300 with a thermoelectric tripping mechanism 302 is depicted. The thermoelectric tripping mechanism 302 includes a support 304 upon which a thermoelectric plate 306 is mounted and a bimetal lever 308 is coupled to the thermoelectric plate 306 via retaining clamp 310. A trip bar 312 is disposed proximate to the bimetal lever 308. The trip bar 312 is linked to a latch 314 that retains a spring within housing 316. (The spring within housing 316 is not visible in the drawings.) The spring provides tension to maintain a contact (also within the housing and thus not visible in the drawings) pressed against load plate 318.

Figure 5:
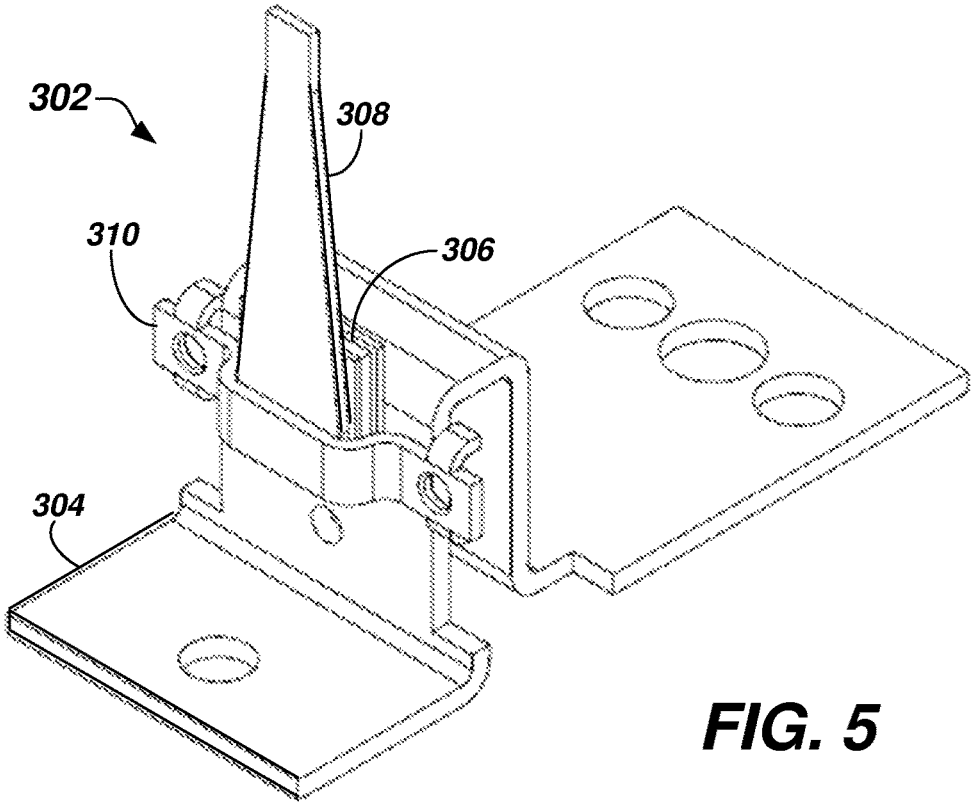
FIG. 5 is an isometric view diagram depicting an example thermoelectric tripping mechanism according to some embodiments.
Figure 6:
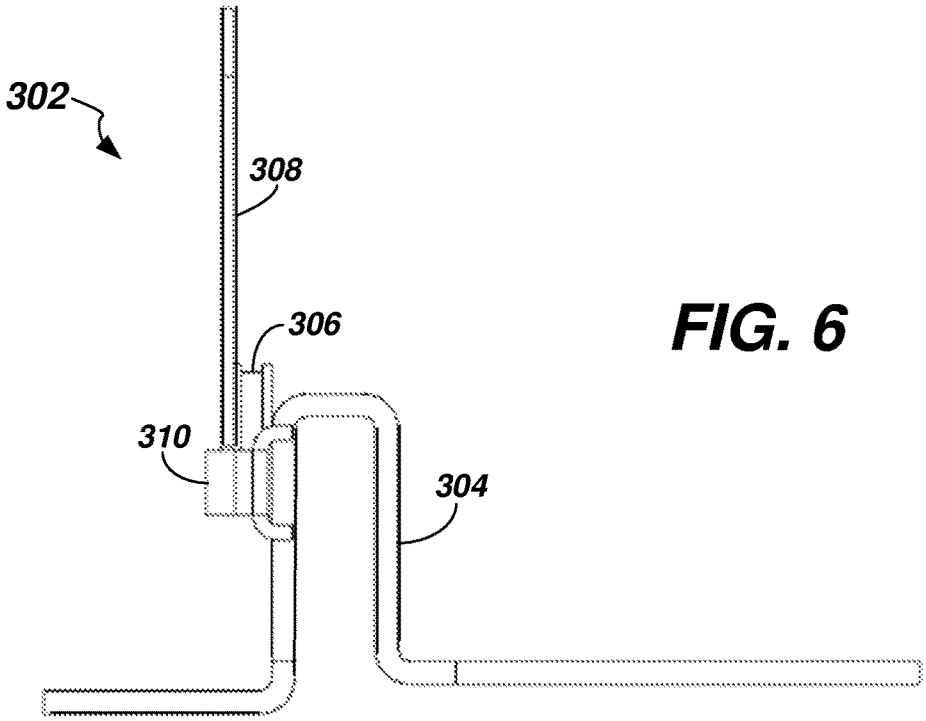
FIG. 6 is a side view diagram depicting an example thermoelectric tripping mechanism according to some embodiments.
Figure 7:
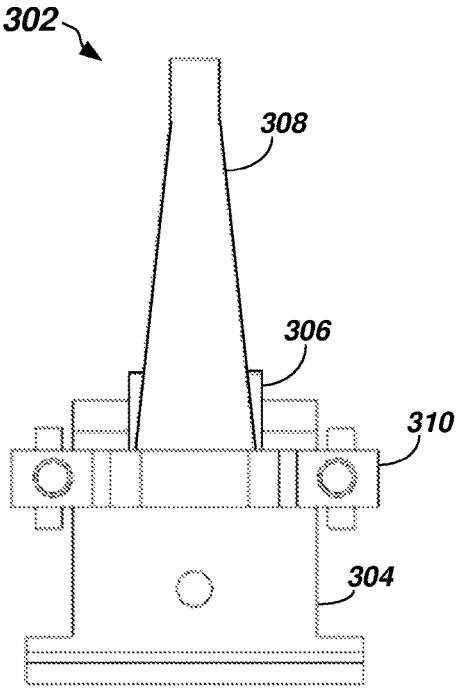
FIG. 7 is a front view diagram depicting an example thermoelectric tripping mechanism according to some embodiments.
Figure 8:
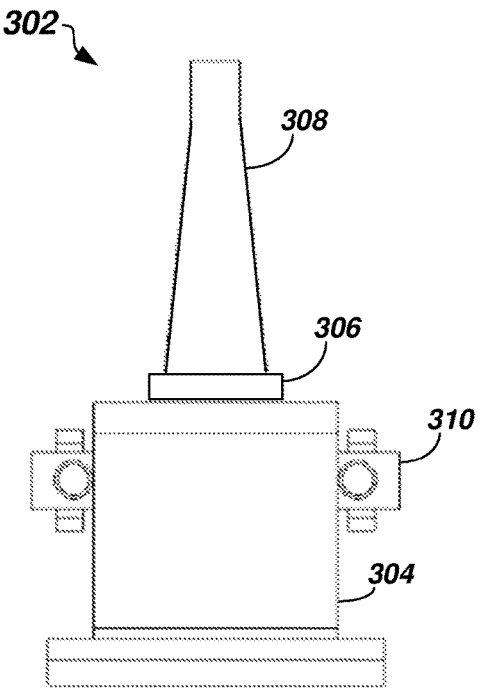
FIG. 8 is a back view diagram depicting an example thermoelectric tripping mechanism according to some embodiments.
Figure 9:
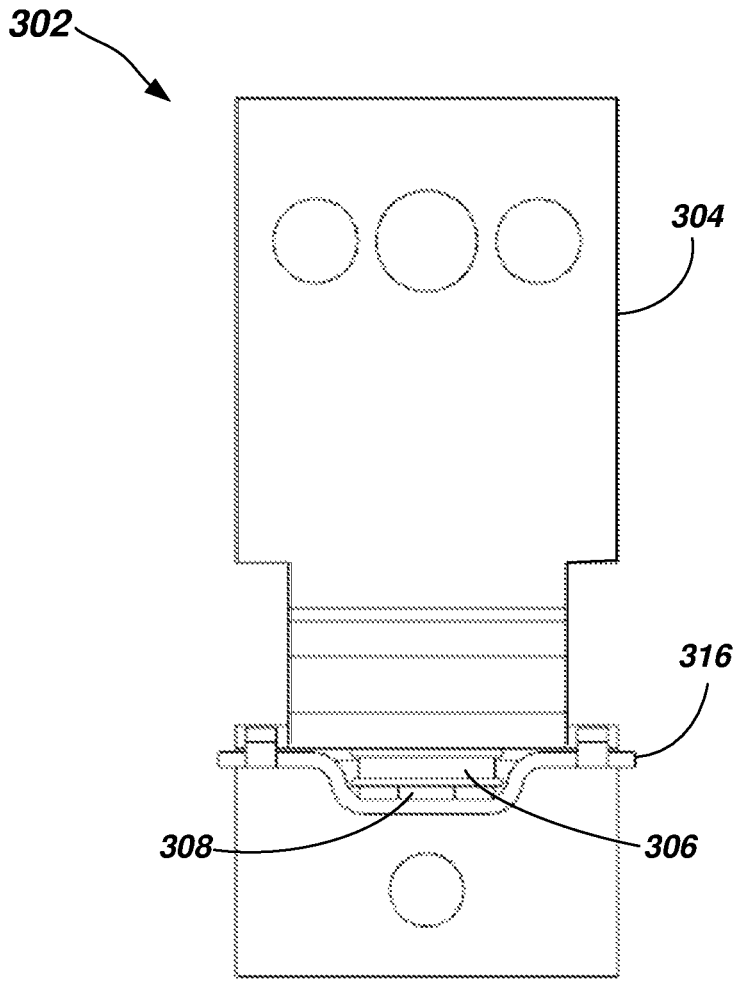
FIG. 9 is a top view diagram depicting an example thermoelectric tripping mechanism according to some embodiments.
Figure 10:
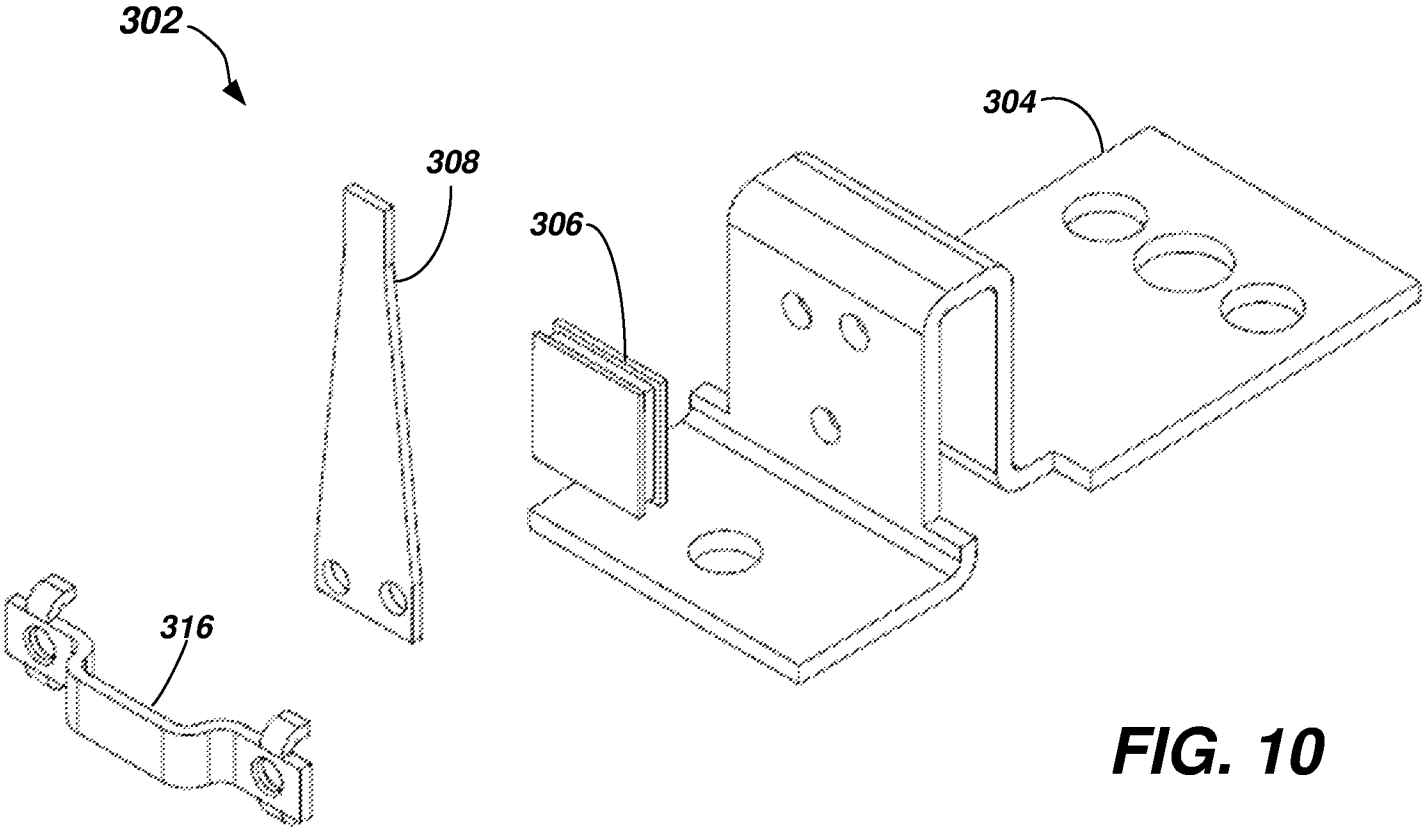
FIG. 10 is an exploded isometric view diagram depicting an example thermoelectric tripping mechanism according to some embodiments.

FIGS. 5 through 10 provide detailed views of the thermoelectric tripping mechanism 302. FIG. 5 is an isometric view and FIG. 6 is a side view of the thermoelectric tripping mechanism 302. FIGS. 7, 8 and 9 are front, back, and top views respectively of the thermoelectric tripping mechanism 302. FIG. 10 is an exploded isometric view.

Referring to FIGS. 3 through 10, in operation, the thermoelectric plate 306 provides heat to the bimetal lever 308 when an overload condition exists. The bimetal lever 308 deflects in response to the heat and presses against the trip bar 312 which in turn disengages the latch 314. Releasing the latch 314 frees the spring to open the current path by disengaging the contact from the load plate 318.

Notably, support 304 is used as a heat sink by the thermoelectric plate 306 and thus, a narrowed section which creates the conventional "heater" is not needed. Therefore, the overall width of support 304 can be significantly smaller than the widest portion of the structure conventionally used for supporting the bimetal lever. For example, whereas a conventional structure for a 600A breaker may be formed from approximately 0.091" inch thick material with a reduced cross section from approximately 1.5" in its widest area to approximately 0.96" in the narrowest area ("for heating effects") and a length of approximately 5 inches, the support 304 of present embodiments can be reduced to being only approximately 4 inches long and approximately 1.2" wide for an overall reduction of material of approximately 20%.

Figure 11:
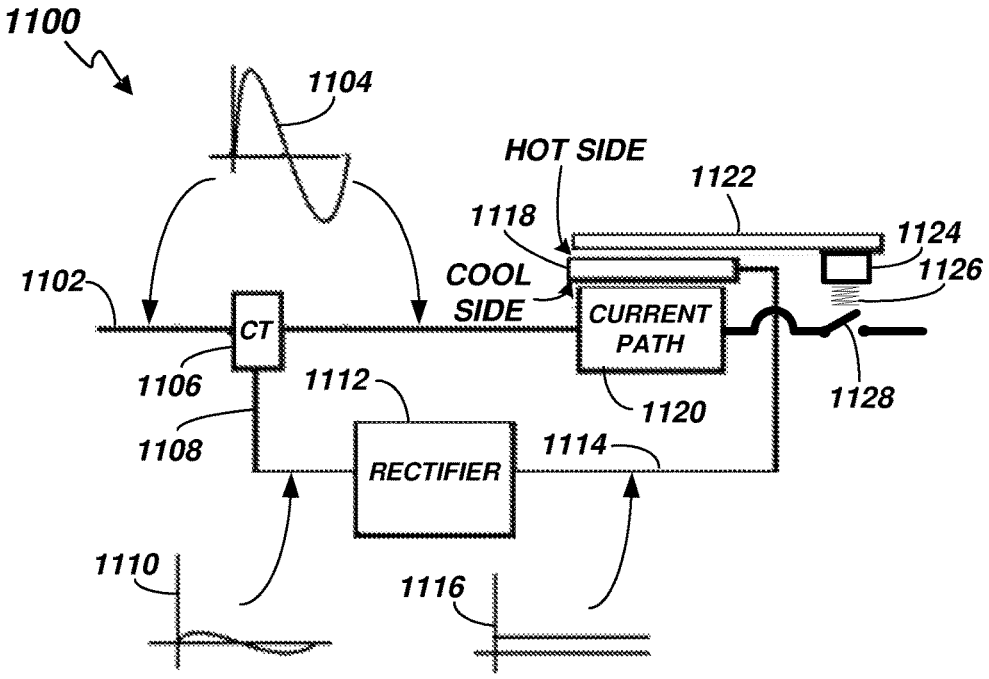
FIG. 11 is a circuit diagram depicting a first example circuit for wiring a thermoelectric tripping mechanism according to some embodiments.

Turning now to FIG. 11, a schematic diagram of an example circuit 1100 for a thermoelectric tripping mechanism 302 is provided. In the example circuit 1100 shown, input line 1102 carries AC line current, as indicated by graph 1104, to current transformer 1106 and along the current path 1120. Current transformer 1106 outputs a stepped down AC current (e.g., lower power) on line 1108, as indicated by graph 1110, which flows to the input of rectifier 1112. Rectifier 1112 outputs a DC current on line 1114, as indicated by graph 1116, which flows to the thermoelectric plate 1118. The cool side of the thermoelectric plate 1118 is coupled to and uses the current path 1120 as a heat sink. The hot side of the thermoelectric plate 1118 is coupled to and heats the bimetal lever 1122. When a current overload occurs on the current path 1120, the bimetal lever 1122 deflects due to the additional heat generated by the increased current supplied to the thermoelectric plate 1118. The deflected bimetal lever 1122 presses upon the trip bar 1124 to release the stored energy spring 1126 which opens contacts 1128 to interrupt the circuit.

Figure 12:
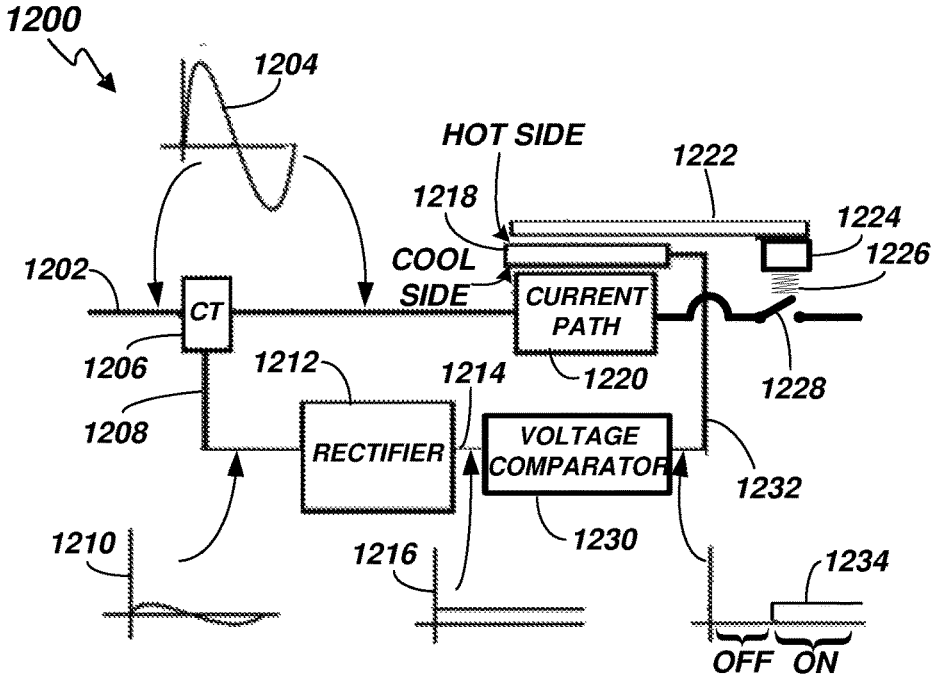
FIG. 12 is a circuit diagram depicting a second example circuit for wiring a thermoelectric tripping mechanism according to some embodiments.

In some embodiments, the DC current applied to the thermoelectric plate 1218 can be controlled so that current only flows to it above a predefined value as illustrated in FIG. 12. Gating the signal to the thermoelectric plate 1218 eliminates or greatly simplifies the thermal calibration process of the circuit breaker. FIG. 12 depicts a schematic diagram of a second example circuit 1200 for a thermoelectric tripping mechanism 302. In the second example circuit 1200 shown, input line 1202 carries AC line current, as indicated by graph 1204, to current transformer 1206 and along the current path 1220. Current transformer 1206 outputs a stepped down AC current (e.g., lower power) on line 1208, as indicated by graph 1210, which flows to the input of rectifier 1212. Rectifier 1212 outputs a DC current on line 1214, as indicated by graph 1216, which flows to voltage comparator 1230. Voltage comparator 1230 also receives a reference voltage (not shown) that is used to calibrate the second example circuit 1200.

If the voltage of the DC current from the rectifier 1212 is less than the reference voltage, the voltage comparator 1230 does not output any current on line 1232 as indicated in the "OFF" portion of graph 1234. If however, the voltage of the DC current from the rectifier 1212 is greater than the reference voltage, the voltage comparator 1230 does output a current on line 1232 as indicated in the "ON" portion of graph 1234.

The cool side of the thermoelectric plate 1218 is coupled to the bimetal lever 1222. The hot side of the thermoelectric plate 1218 is coupled to the current path 1220. When a current overload occurs on the current path 1220, the voltage of the DC current from the rectifier 1212 exceeds the reference voltage, a current is applied to line 1232, and the thermoelectric plate 1218 is energized to heat the bimetal lever 1222 and to use the current path 1220 as a heat sink. The heated bimetal lever 1222 deflects due to the heat from the thermoelectric plate 1218 and the deflected bimetal lever 1222 presses upon the trip bar 1224 to release the stored energy spring 1226 which opens contacts 1228 to interrupt the circuit.

Therefore, a benefit of the embodiment of FIG. 12 is that the precise position and amount of physical deflection of the bimetal lever 1222 in response to heat from the thermoelectric plate 1218 (driven by current from the current path 1220) does not need to be accurately calibrated. In other words, since the bimetal lever 1222 is not heated at all during normal operation and only heated when an overload condition exists, the bimetal lever 1222 can be disposed immediately adjacent the trip bar 1224 and any deflection of the bimetal lever 1222 can be used to trigger the trip bar 1224. The reference voltage supplied to the voltage comparator 1230 is used to determine how much current on the current path should cause the breaker to be tripped by gating the DC current supplied to the thermoelectric plate 1218 until the current on the current path 1220 exceeds an overload condition threshold. Thus, instead of having to precisely configure the position and physical response of the bimetal lever 1222, the voltage comparator 1230 allows binary operation of the thermoelectric plate 1218. A further benefit is that since the bimetal lever 1222 is only heated when an overload condition occurs, energy consumption is reduced.

Figure 13:
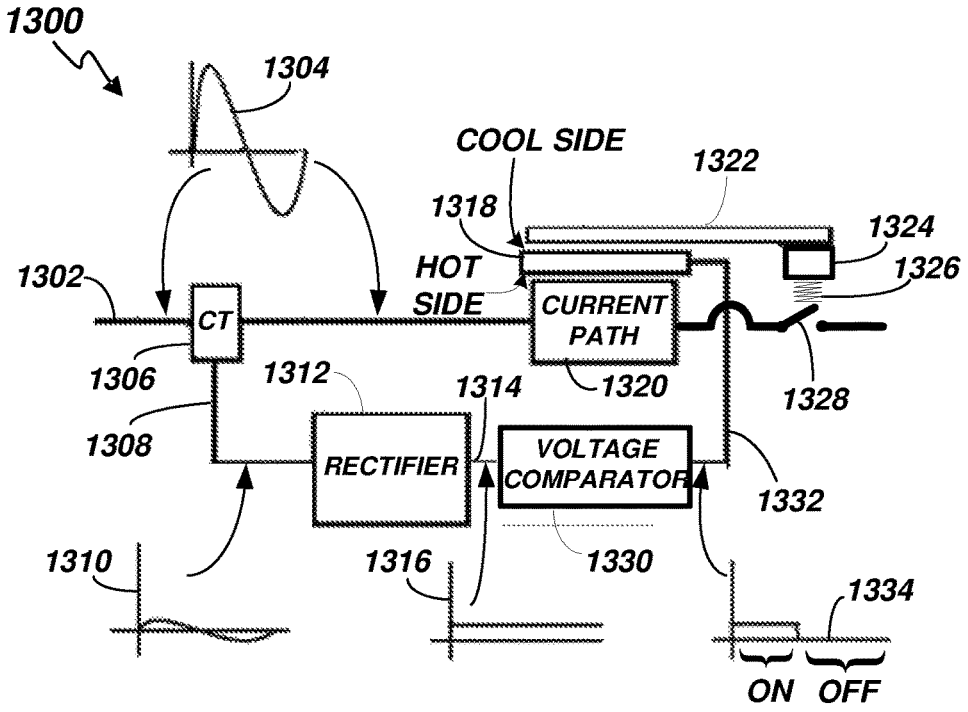
FIG. 13 is a circuit diagram depicting a third example circuit for wiring a thermoelectric tripping mechanism according to some embodiments.

FIG. 13 depicts a third example circuit 1300 for a thermoelectric tripping mechanism 302. The third example circuit 1300 provides improved reliability and safety features. In the third example circuit 1300 shown, input line 1302 carries AC line current, as indicated by graph 1304, to current transformer 1306 and along the current path 1320. Current transformer 1306 outputs a stepped down AC current (e.g., lower power) on line 1308, as indicated by graph 1310, which flows to the input of rectifier 1312. Rectifier 1312 outputs a DC current on line 1314, as indicated by graph 1316, which flows to voltage comparator 1330. Voltage comparator 1330 also receives a reference voltage (not shown) that is used to calibrate the third example circuit 1300.

In normal operation, voltage comparator 1330 applies a current on line 1332 that flows to the thermoelectric plate 1318 as shown in the "ON" portion of graph 1334. The thermoelectric plate 1318 is disposed with the cool side against the bimetal lever 1322 and the hot side against the current path 1320. Thus, in normal operation, the bimetal lever 1322 is held in a deflected position without pressing on the trip bar 1324. In a current overload condition, the voltage comparator 1330 cuts off the current on line 1332 and flow to the thermoelectric plate 1318 is stopped as shown in the "OFF" portion of graph 1334. The bimetal lever 1322 is no longer cooled and thus, returns to a non-deflected position which presses on the trip bar 1324 to release the stored energy spring 1326 which opens contacts 1328 to interrupt the circuit.

Therefore, in addition to the reduced configuration benefit of binary operation due to the use of a voltage comparator 1330, a safety and reliability benefit of the embodiment of FIG. 13 is that even if a component fails and no longer conducts, the circuit breaker will be interrupted since without power, the third example circuit 1300 defaults to a tripped state.

Note that throughout the present specification, the term "bimetal lever" is used to refer to the temperature responsive structure that deflects due to different coefficients of thermal expansion of the materials used to form the lever. In some embodiments, three, four, or more materials can be used to form a temperature responsive lever. Thus, the term "bimetal" is only used for clarity and convenience and one of ordinary skill will understand that multiple materials (including non-metal) can be used together to form a temperature responsive lever.

Further, in some embodiments, the current path is used as a heat sink for the bimetal lever. However, a heat sink is not required in some embodiments and alternatively, a separate heat sink can be used. In some embodiments, a transceiver (e.g., a wired or wireless transceiver) can be coupled to the voltage comparator to adjust the reference voltage. Thus, a remote signal can be transmitted to the voltage comparator to cause the circuit breaker to trip. Likewise, in some embodiments, the transceiver can be connected to the output of the voltage comparator to send a signal when the thermoelectric plate is being energized or not, or if there is a change in the signal to the thermoelectric plate, indicating the occurrence of an overload condition and/or a current status of the circuit breaker.

Figure 14:
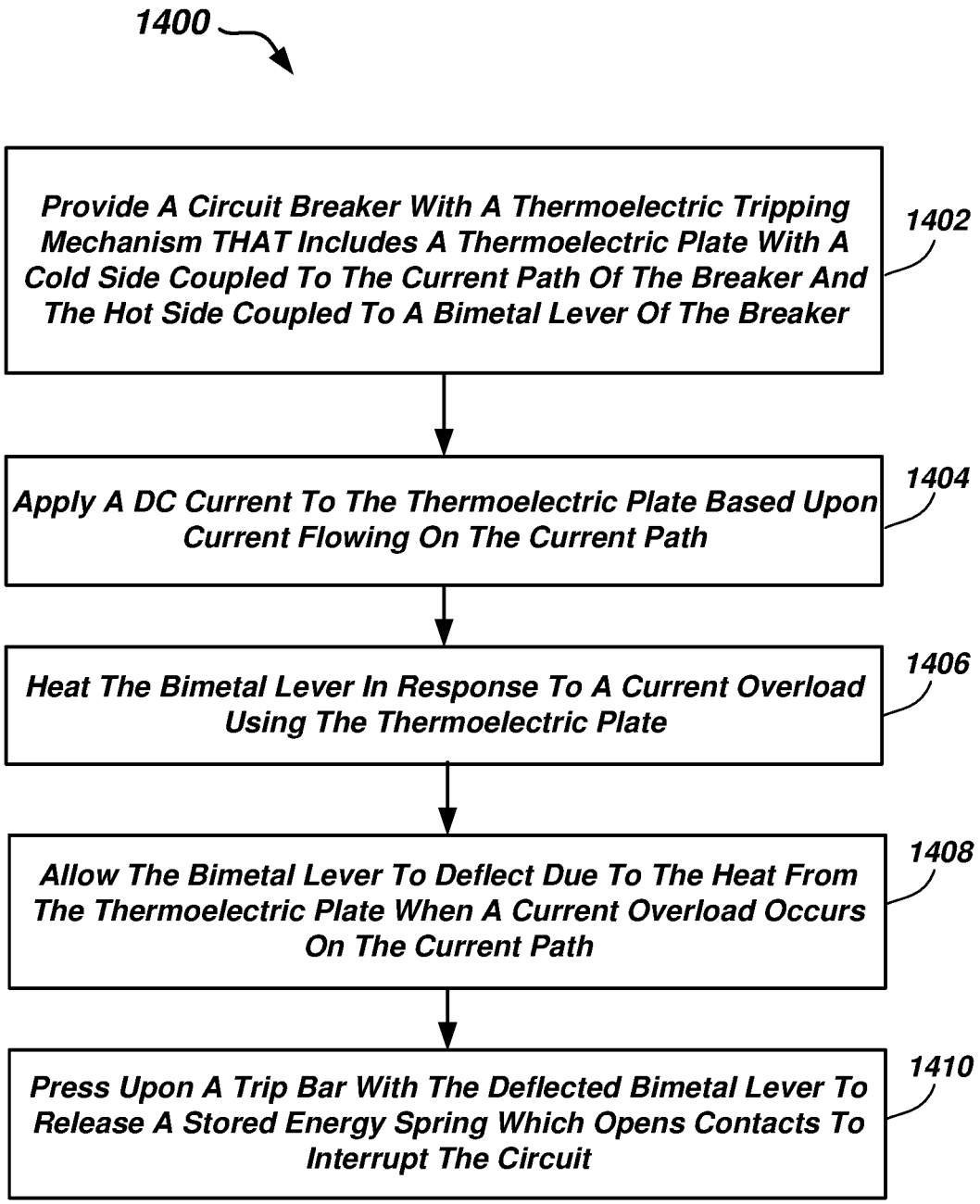
FIG. 14 is a flowchart illustrating an example method according to some embodiments.

Turning now to FIG. 14, a flow chart 1400 depicting an example method of tripping a circuit breaker is described. A circuit breaker including a thermoelectric tripping mechanism is provided (1402). The thermoelectric tripping mechanism includes a thermoelectric plate with a cold side coupled to the current path of the circuit breaker and the hot side coupled to a bimetal lever of the breaker. A DC current is applied to the thermoelectric plate with a magnitude based on the amount of current flowing on the current path (1404). The thermoelectric plate heats the bimetal lever in proportion to the amount of current flowing on the current path and uses the current path as a heat sink (1406). When a current overload occurs on the current path, the bimetal lever is further heated and deflects due to the increased energy on the current path (1408). The deflected bimetal lever presses upon the trip bar to release the stored energy spring which opens contacts to interrupt the circuit (1410).

Numerous embodiments are described in this disclosure, and are presented for illustrative purposes only. The described embodiments are not, and are not intended to be, limiting in any sense. The presently disclosed embodiments are widely applicable to numerous other embodiments, as is readily apparent from the disclosure. One of ordinary skill in the art will recognize that the disclosed embodiments may be practiced with various modifications and alterations, such as structural, logical, software, and electrical modifications. Although particular features of the disclosed embodiments may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the embodiments that must be present in all embodiments. The present disclosure provides, to one of ordinary skill in the art, an enabling description of several embodiments. Some of these embodiments may not be claimed in the present application, but may nevertheless be claimed in one or more continuing applications that claim the benefit of priority of the present application.

The foregoing description discloses only example embodiments. Modifications of the above-disclosed apparatus, systems. and methods which fall within the scope of the claims will be readily apparent to those of ordinary skill in the art. Accordingly, while the embodiments have been disclosed in connection with example embodiments thereof, it should be understood that other embodiments may fall within the intended scope, as defined by the following claims.

What is claimed is:

1. A circuit breaker comprising:

a current path including contacts openable to interrupt a circuit;

a thermoelectric tripping mechanism adjacent the current path, the thermoelectric tripping mechanism including a thermoelectric plate disposed between the current path and a bimetal lever, wherein the thermoelectric tripping mechanism includes a support upon which the thermoelectric plate is mounted, wherein the support is used as a first heat sink by the thermoelectric plate, wherein the thermoelectric plate includes a cold side coupled to the current path and a hot side coupled to the bimetal lever, and wherein the cold side uses the current path as a second heat sink and the hot side heats the bimetal lever; and a trip bar disposed to be pressed by the bimetal lever, the trip bar coupled to a stored energy mechanism releasable to open the contacts.

2. The circuit breaker of claim 1 wherein the thermoelectric tripping mechanism includes a DC power supply coupled to the thermoelectric plate.

3. The circuit breaker of claim 2 wherein the thermoelectric plate is operative to heat the bimetal lever and use the current path as a heat sink.

4. The circuit breaker of claim 2 wherein the DC power supply includes a current transformer coupled to the current path.

5. The circuit breaker of claim 4 wherein the DC power supply further includes a rectifier coupled to the current transformer and the thermoelectric plate.

6. A thermoelectric tripping mechanism comprising:

a current path;

a bimetal lever;

a support; and a thermoelectric plate disposed between the current path and the bimetal lever, wherein the thermoelectric plate is mounted upon the support, wherein the support is used as a first heat sink by the thermoelectric plate, wherein the thermoelectric plate includes a cold side coupled to the current path and a hot side coupled to the bimetal lever, and wherein the cold side uses the current path as a second heat sink and the hot side heats the bimetal lever.

7. The thermoelectric tripping mechanism of claim 6 further including a DC power supply coupled to the thermoelectric plate.

8. The thermoelectric tripping mechanism of claim 7 wherein the thermoelectric plate is operative to heat the bimetal lever.

9. The thermoelectric tripping mechanism of claim 7 wherein the DC power supply includes a current transformer coupled to the current path.

10. The thermoelectric tripping mechanism of claim 9 wherein the DC power supply further includes a rectifier coupled to the current transformer and the thermoelectric plate.

* * * * *